US009117600B2

(12) United States Patent
Izawa et al.

(10) Patent No.: US 9,117,600 B2
(45) Date of Patent: Aug. 25, 2015

(54) ELECTRIC MAGNET DEVICE AND SWITCH PROVIDED THEREWITH

(71) Applicant: Omron Corporation, Kyoto-shi (JP)

(72) Inventors: Kazuhira Izawa, Okayama (JP); Kenshi Nagata, Kurayoshi (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/953,963

(22) Filed: Jul. 30, 2013

(65) Prior Publication Data

US 2014/0070909 A1 Mar. 13, 2014

(30) Foreign Application Priority Data

Sep. 11, 2012 (JP) ..... 2012-199680

(51) Int. Cl.

| | |
|---|---|
| ***H01H 3/00*** | (2006.01) |
| ***H01H 3/28*** | (2006.01) |
| ***H01H 50/04*** | (2006.01) |
| ***H01H 50/16*** | (2006.01) |
| ***H01H 50/22*** | (2006.01) |
| ***H01H 50/30*** | (2006.01) |
| ***H01H 51/01*** | (2006.01) |

(52) U.S. Cl.

CPC ..... *H01H 3/28* (2013.01); *H01H 50/042* (2013.01); *H01H 50/163* (2013.01); *H01H 50/22* (2013.01); *H01H 50/30* (2013.01); *H01H 51/01* (2013.01)

(58) Field of Classification Search

CPC ..... H01F 7/14; H01F 2007/085; H01F 7/06; H01H 50/18; H01H 51/2245; H01H 3/28; H01H 9/00

USPC ..... 335/192

See application file for complete search history.

(56) References Cited

U.S. PATENT DOCUMENTS

| | | | | | |
|---|---|---|---|---|---|
| 2,328,831 | A | * | 9/1943 | Mendelsohn et al. | 396/185 |
| 2,445,435 | A | * | 7/1948 | Jennings et al. | 310/36 |
| 2,490,225 | A | * | 12/1949 | McGall | 396/185 |
| 2,536,468 | A | * | 1/1951 | Russell | 361/259 |
| 2,567,290 | A | * | 9/1951 | Livingston | 310/36 |
| 3,141,939 | A | * | 7/1964 | Mink | 335/126 |

(Continued)

FOREIGN PATENT DOCUMENTS

| | | | |
|---|---|---|---|
| EP | 1511051 | A2 | 3/2005 |
| JP | 2001135521 | A | 5/2001 |

OTHER PUBLICATIONS

European Search Report for Corresponding application EP13178744.2 ; Report Dated Mar. 7, 2014.

*Primary Examiner* — Shawki S Ismail
*Assistant Examiner* — Lisa Homza
(74) *Attorney, Agent, or Firm* — Klarquist Sparkman, LLP

(57) ABSTRACT

An aspect of the present invention provides an electric magnet device, in which a smooth movement of an armature is ensured and, even if a vibration or an impact is applied, an attraction state between a yoke and the armature is maintained to prevent a malfunction, and a switch provided therewith, where the electric magnet device includes: a coil adapted to insert through an armature and a yoke so as to attract surfaces of the yoke and the armature, which are opposed to each other, to receive a voltage, to excite for separating the surfaces of the yoke and the armature; the armature disposed on one end side of the coil; and the yoke disposed on the other end side of the coil and adapted to oscillate, such that an oscillation angle of the yoke is greater than that of the armature.

14 Claims, 9 Drawing Sheets

(56) References Cited

U.S. PATENT DOCUMENTS

| | | | | | |
|---|---|---|---|---|---|
| 3,238,398 | A | * | 3/1966 | Trbovich et al. | 310/29 |
| 3,242,356 | A | * | 3/1966 | Davis, Jr. | 310/29 |
| 3,242,357 | A | * | 3/1966 | Guichard | 310/37 |
| 3,381,150 | A | * | 4/1968 | Trbovich et al. | 310/29 |
| 3,553,729 | A | * | 1/1971 | Mori et al. | 35/192 |
| 4,322,700 | A | * | 3/1982 | Everhart et al. | 335/128 |
| 4,492,942 | A | * | 1/1985 | Mueller | 335/202 |
| 4,518,945 | A | * | 5/1985 | Doyle et al. | 340/12.39 |
| 4,656,400 | A | * | 4/1987 | Pailthorp et al. | 318/135 |
| 4,706,056 | A | * | 11/1987 | McCullough | 335/192 |
| 5,127,625 | A | * | 7/1992 | Kleinhappl | 251/129.17 |
| 5,303,012 | A | * | 4/1994 | Horlacher et al. | 335/253 |
| 5,458,150 | A | * | 10/1995 | Tamaoki et al. | 137/596.17 |
| 5,523,684 | A | * | 6/1996 | Zimmermann | 324/207.22 |
| 5,584,465 | A | * | 12/1996 | Ochsenreiter | 251/65 |
| 5,942,892 | A | * | 8/1999 | Li | 324/207.16 |
| 6,293,516 | B1 | * | 9/2001 | Parsons et al. | 251/129.04 |
| 6,305,662 | B1 | * | 10/2001 | Parsons et al. | 251/129.04 |
| 6,450,478 | B2 | * | 9/2002 | Parsons et al. | 251/129.04 |
| 6,739,573 | B1 | * | 5/2004 | Balsdon | 251/129.05 |
| 6,948,697 | B2 | * | 9/2005 | Herbert et al. | 251/129.04 |
| 6,955,334 | B2 | * | 10/2005 | Parsons et al. | 251/129.04 |
| 7,965,161 | B2 | * | 6/2011 | Roche | 335/229 |
| 8,026,781 | B2 | * | 9/2011 | Freakes | 335/245 |
| 8,382,063 | B2 | * | 2/2013 | Watanabe | 251/129.15 |
| 8,505,573 | B2 | * | 8/2013 | Herbert et al. | 137/554 |
| 8,552,823 | B2 | * | 10/2013 | Isonaga | 335/126 |
| 2003/0052760 | A1 | | 3/2003 | Smith | |
| 2005/0127759 | A1 | * | 6/2005 | Kraus et al. | 310/36 |
| 2006/0043798 | A1 | | 3/2006 | Konno | |
| 2010/0123093 | A1 | * | 5/2010 | Beyer et al. | 251/129.15 |
| 2013/0257571 | A1 | * | 10/2013 | Kahl et al. | 335/229 |

* cited by examiner

ELECTRIC MAGNET DEVICE AND SWITCH PROVIDED THEREWITH

CROSS REFERENCE TO RELATED APPLICATION

This application claims benefit of priority to Japanese Patent Application No. 2012-199680 , filed on Sep. 11, 2012 of which the full contents are herein incorporated by reference.

BACKGROUND OF THE INVENTION

The present invention relates to an electric magnet device.

A conventional electric magnet device, for example, Japanese Unexamined Patent Publication No. 2001-135521 discloses an electric magnet device in which a distance between centers of a pair of leg parts formed in an armature is made less than a distance between centers of bobbin holes. The electric magnet device has a structure in which the leg parts abut on an inside surface of the bobbin holes, such that an external force is applied from a predetermined direction to move the armature in the predetermined direction. The armature turns about an end portion of the inside surface with a small turning angle. Therefore, the armature hardly drops off from the yoke to improve an impact resistance.

However, in the electric magnet device, there has been a problem that when the distance between the centers of the leg parts is excessively less than the distance between the centers of the bobbin holes due to a variation of working accuracy of a component, the leg part has a difficulty in moving in the bobbin hole.

The invention provides smooth movement of the armature inside the bobbin and, maintains an attraction state between the yoke and the armature within the electric magnet device.

SUMMARY OF THE INVENTION

In accordance with one aspect of an electric magnet device, the electric magnet device includes: a coil adapted to insert through at least one armature and a yoke so as to attract surfaces of the yoke and the armature which are opposed to each other, to receive a voltage, to excite for separating the surfaces of the yoke and the armature; the armature disposed on one end side of the coil and adapted to oscillate; and the yoke disposed on the other end side of the coil and to oscillate, wherein an oscillation angle of the yoke is greater than an oscillation angle of the armature.

According to an embodiment of the present invention, a ratio of the oscillation angle of the yoke to the oscillation angle of the armature may be greater than 1:1 and less than or equal to 3:1.

According to another embodiment of the present invention, attraction surfaces of the armature and the yoke are having a square shape.

According to a different embodiment of the present invention, attraction surfaces of the armature and the yoke may are having a circular shape.

According to still another embodiment of the electric magnet, the yoke includes an assembly notch in each of both lateral edge portions of the yoke.

The invention further provides a switch including the electric magnet device described above.

DETAILED DESCRIPTION

A reset-function-equipped switch 1 incorporating an electric magnet device according to a first embodiment of the present invention is described with reference to the accompanying drawings of FIGS. 1 to 8.

Figure 1:
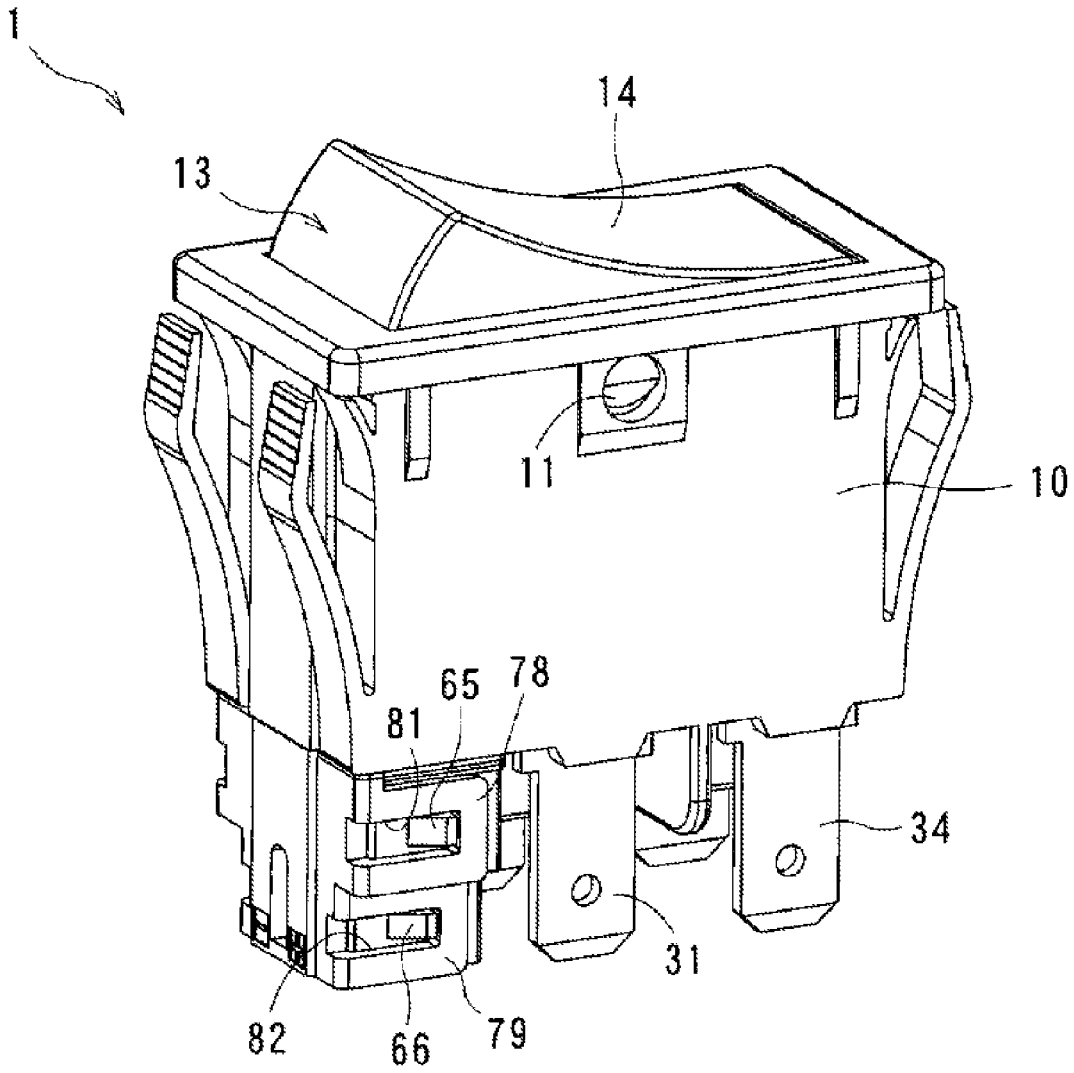
FIG. 1 is a perspective view illustrating a switch incorporating an electric magnet device according to a first embodiment of the present invention.
Figure 2:
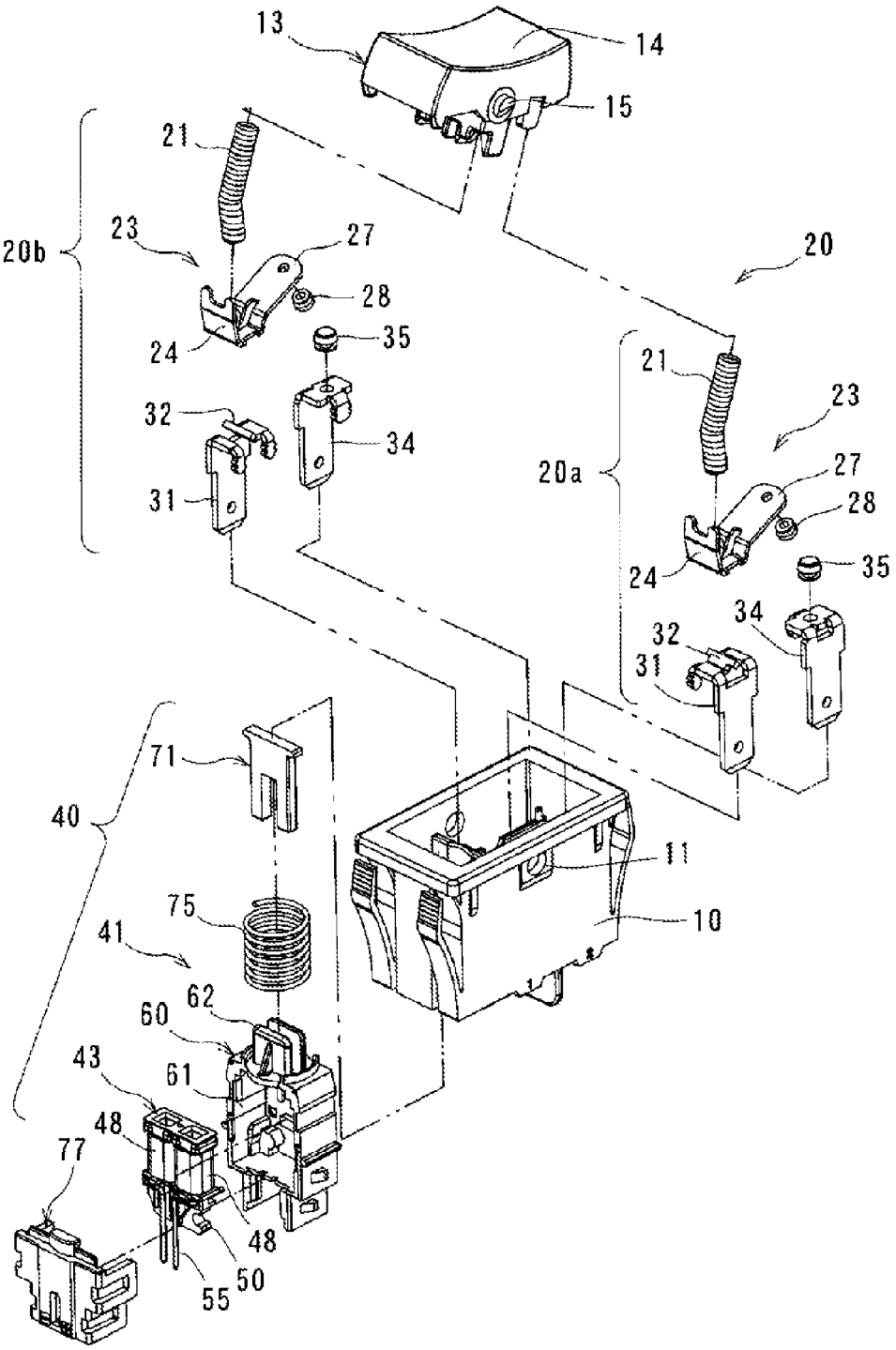
FIG. 2 is an exploded perspective view of the switch in FIG. 1.
Figure 3:
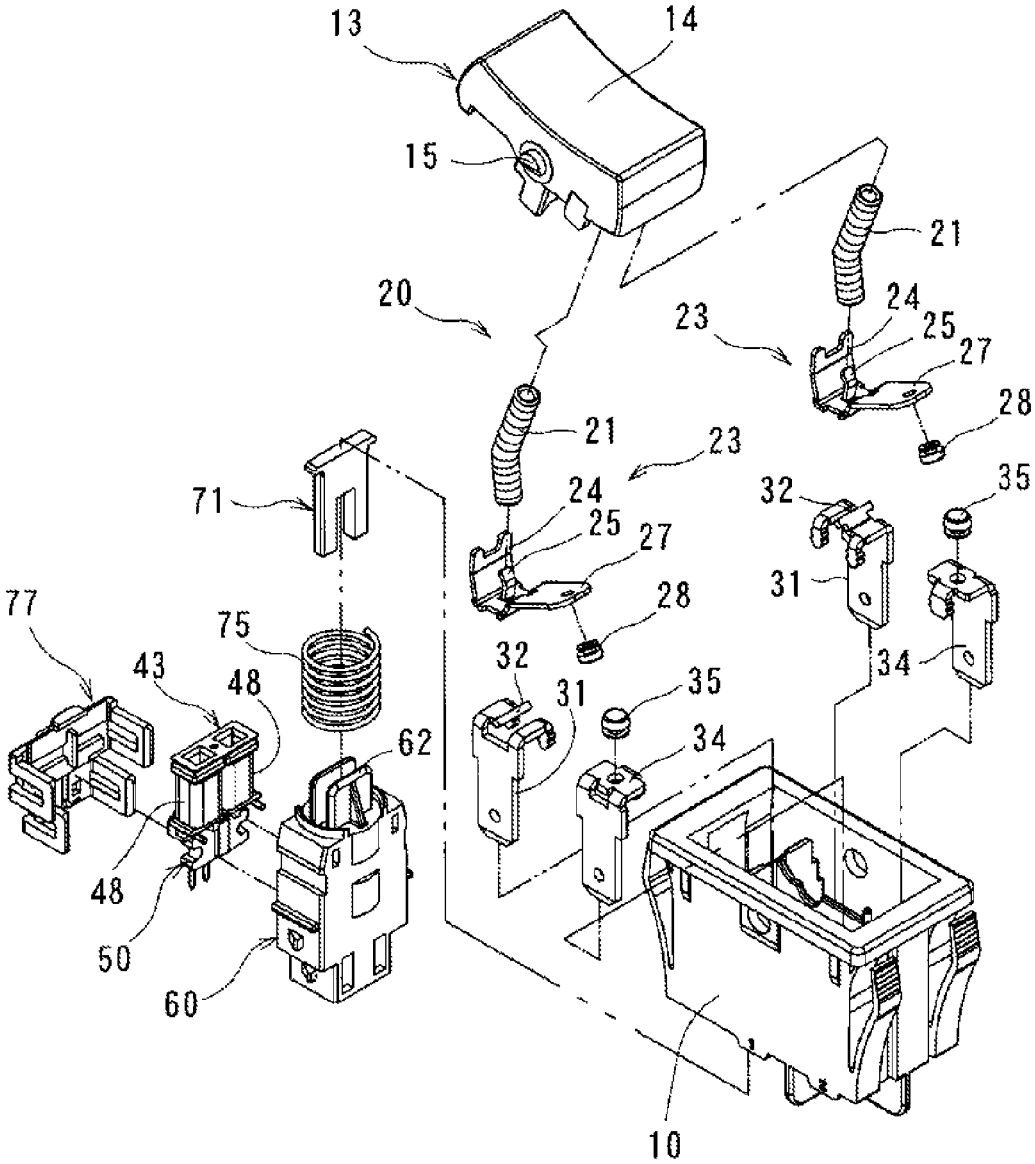
FIG. 3 is an exploded perspective view of the switch in FIG. 1 when viewed from a direction different from that in FIG. 2.

As illustrated in FIGS. 1 to 3, the switch 1 includes a housing 10, an operation piece 13, a power switch mechanism 20, and a drive mechanism 40.

The housing 10 has a box shape with an upper portion being opened, and the housing 10 is configured such that the power switch mechanism 20 is disposed on one side of its inner space while the drive mechanism 40 is disposed on the other side of the inner space.

Figure 6B:
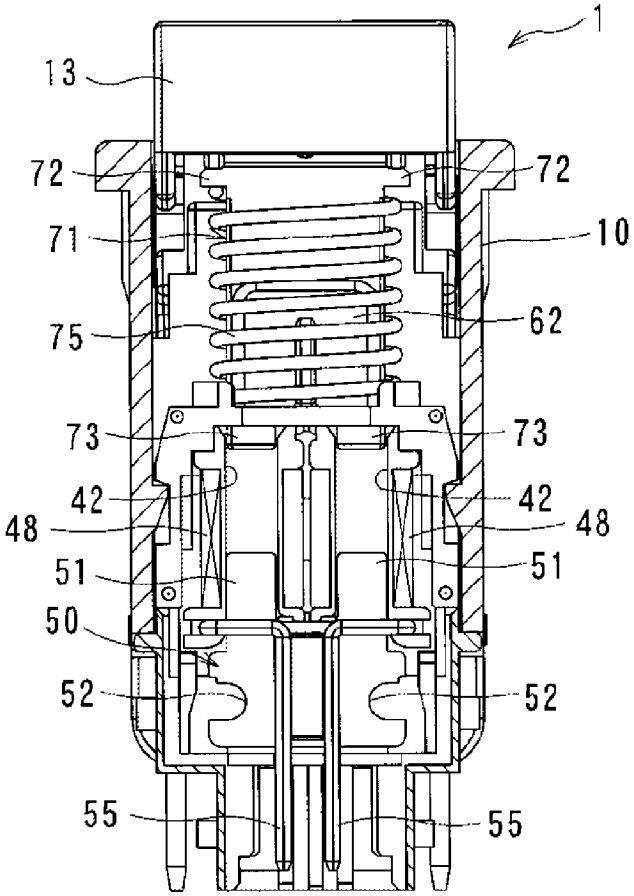
FIG. 6B is a side sectional view illustrating the switch in FIG. 6A.
Figure 6A:
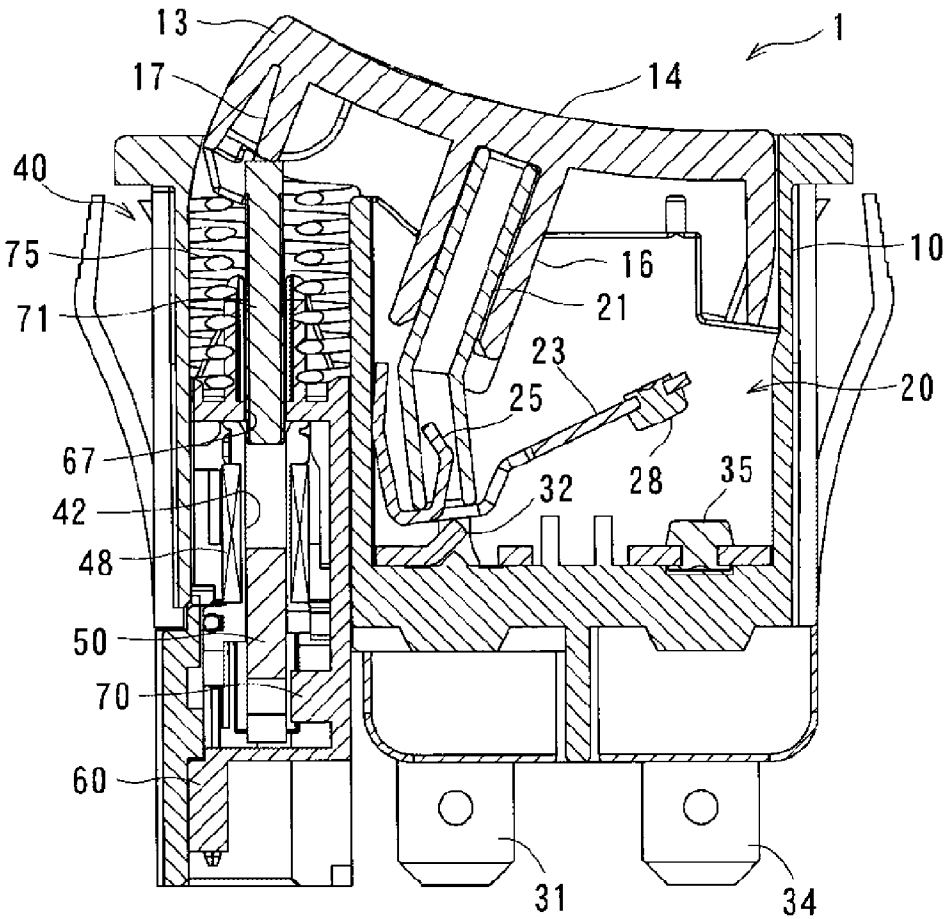
FIG. 6A is a front sectional view illustrating the switch before an operation.

The operation piece 13 has a substantially rectangular box shape with a lower surface being opened, and the operation piece 13 includes an operation surface 14, a support shaft 15, a retention part 16 (see FIG. 6A), and an abutment plate 17 (see FIG. 6A). The operation surface 14 is formed as a curved surface on the upper surface of the operation piece 13. The support shaft 15 protrudes outward from center of both side surfaces, opposite to each other, of the operation piece 13. The retention part 16 protrudes downward from center of a backside of the operation surface 14, and a coupling body 21 is fitted in and retained by the retention part 16. The abutment plate 17 protrudes downward from an end portion of the backside of the operation surface 14, and abuts on an upper end of an armature 71. The support shaft 15 is fitted in a circular hole 11 of the housing 10, whereby the operation piece 13 is mounted to the housing 10 so as to be turnable about the support shaft 15.

The power switch mechanism 20 includes a first power switch mechanism 20*a* and a second power switch mechanism 20*b* , which are disposed in parallel in the housing 10. The first and the second power switch mechanism 20*a* , 20*b* includes the coupling body 21, a movable contact piece 23, a first fixed contact piece 31, and a second fixed contact piece 34.

The coupling body 21 is composed of a coil spring bent into a chevron shape. As illustrated in FIG. 6A, with the switch 1 being assembled, an upper end portion of the coupling body 21 is fitted in and retained by the retention part 16 of the operation piece 13, and a lower end portion of the coupling body 21 is inserted in and supported by a protrusion 25 of a movable contact piece 23.

As illustrated in FIG. 3, the movable contact piece 23 includes a support part 24 bent into a substantial L-shape and a tongue piece 27 that extends obliquely upward from the end portion of the support part 24. The chevron-shape protrusion 25 that protrudes upward is formed in a horizontal surface of the support part 24. A movable contact 28 is provided at a leading end of the tongue piece 27.

A first fixed contact piece 31 has a vertically reverse L-shape, and a first fixed contact 32 is formed in the upper surface of the first fixed contact piece 31 by cutting and raising the first fixed contact piece 31. Similarly, a second fixed contact piece 34 has a vertically reverse L-shape, and a second fixed contact 35 is attached to the upper surface of the second fixed contact piece 34. Because the second power switch mechanism 20*b* is composed of the same components as the first power switch mechanism 20*a* , the same component is designated by the same numeral, and the description thereof is omitted.

Figure 4:
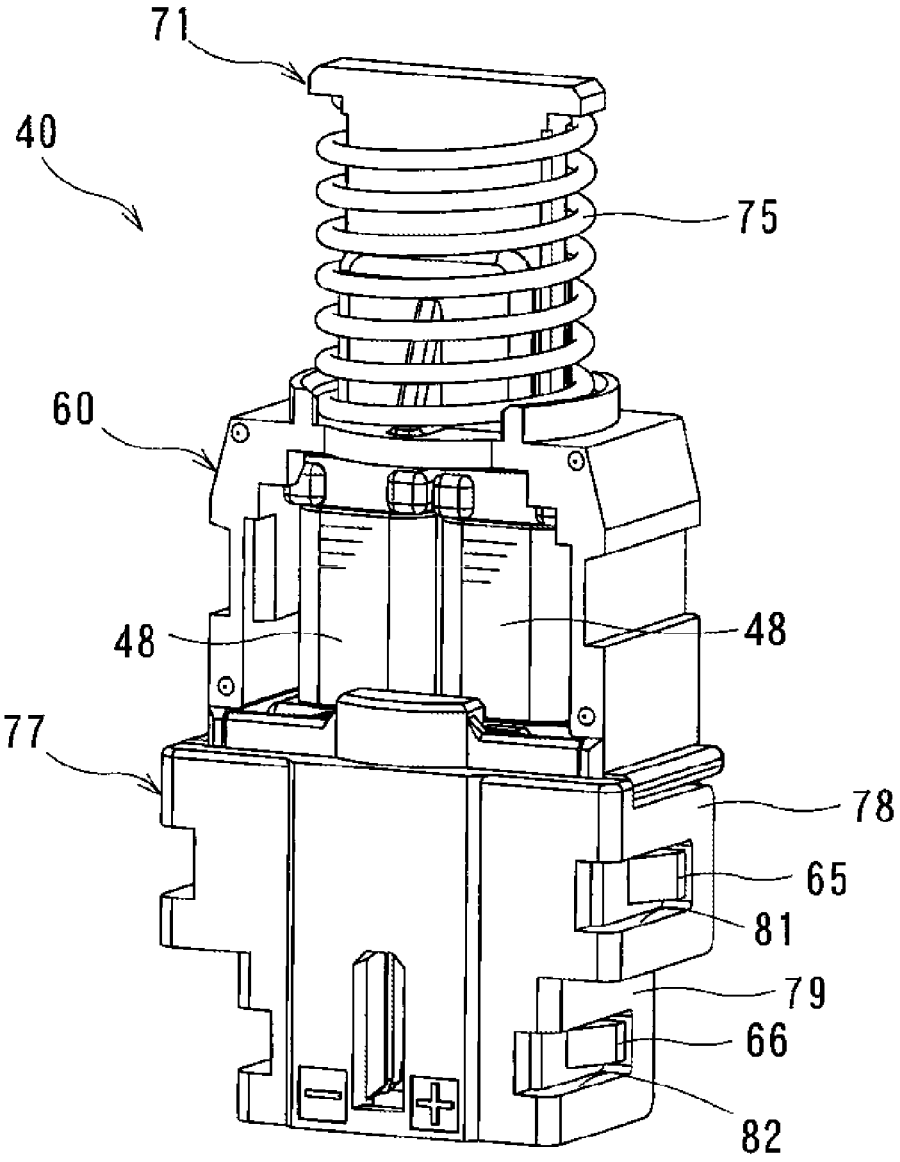
FIG. 4 is a perspective view illustrating an electric magnet device of an embodiment of the present invention.
Figure 5:
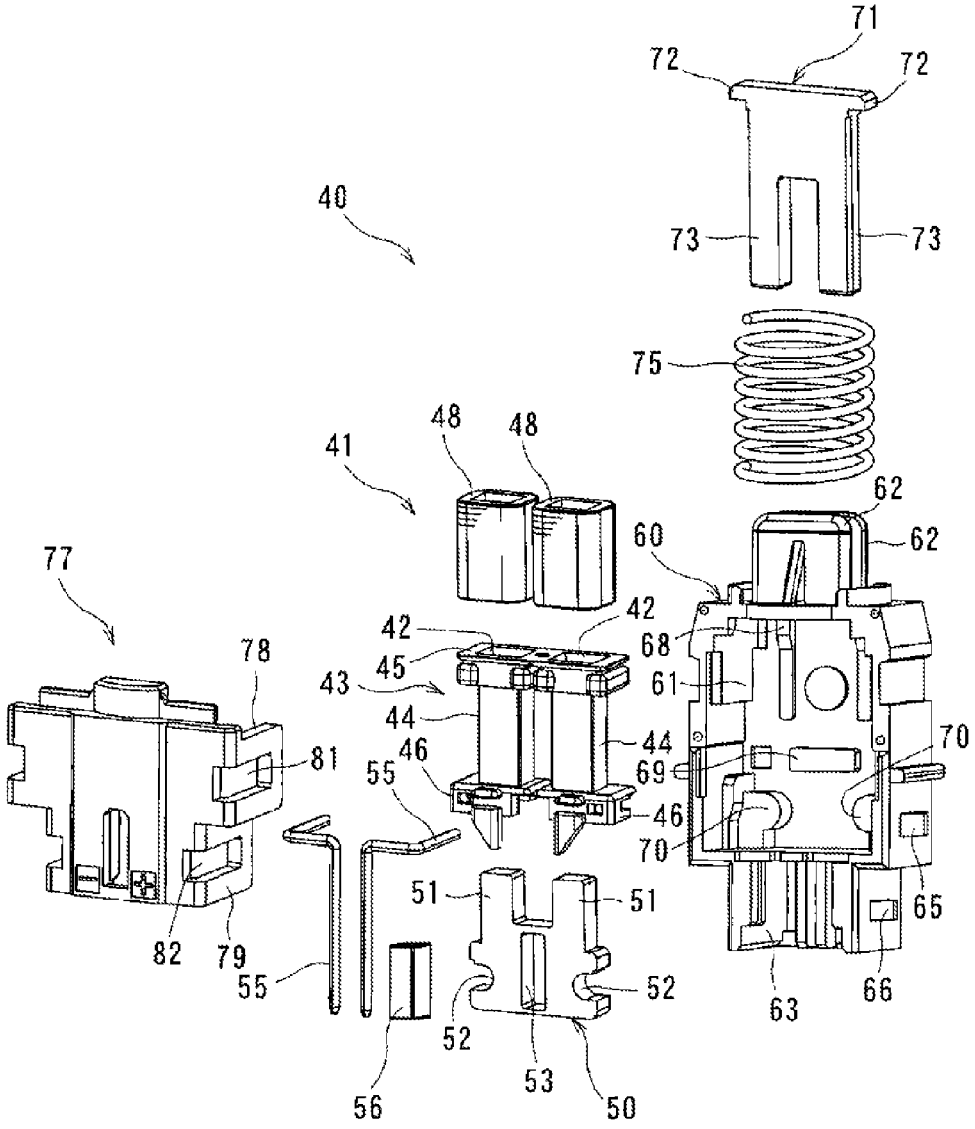
FIG. 5 is an exploded perspective view of the electric magnet device in FIG. 4.

As illustrated in FIGS. 4 and 5, the drive mechanism 40 includes an electric magnet device 41, a case 60, a return spring 75, and a cover 77.

The electric magnet device 41 includes a bobbin 43 that includes a vertically piercing through-hole 42, a coil 48 that is wound around the bobbin 43, a yoke 50 that is inserted through the through-hole 42 of the bobbin 43 from below, and the armature 71 that is inserted through the through-hole 42 of the bobbin 43 from above.

The bobbin 43 includes two coil-winding parts 44 provided in parallel, an upper end edge part 45, and a lower end edge part 46. The coil winding part 44 is cylindrical having a rectangular shape in section, and the coil 48 is wound around an outer periphery of the coil winding part 44. The upper end edge part 45 is formed at the upper end of the coil winding part 44, and the upper end edge part 45 integrally connects the two coil winding parts 44. The lower end edge part 46 is composed of a rectangular frame body formed at the lower end of each coil winding part 44, a reset signal input terminal 55 to which a bound leads of the coil 48 is connected is press-fitted in and fixed to the lower end edge part 46.

The yoke 50 is made of a plate-like magnetic material that enhances magnetic efficiency of a permanent magnet 56 (to be described). The yoke 50 also includes a pair of upwardly extending arm parts 51, a pair of notches 52 that are formed on the lower side of the lateral surface and curved inward into a U-shape, and a linear attaching hole 53 that is formed in the center so as to extend vertically. The rectangular-solid-shape permanent magnet 56 is fitted in and fixed to the he attaching hole 53.

The case 60 includes a storage part 61 in which the electric magnet device 41 is stored, a pair of guide plates 62 formed above the storage part 61, and a socket 63 formed below the storage part 61. An upper-side latching protrusion 65 and a lower-side latching protrusion 66, which protrude outward, are formed in both side surfaces of the case 60. An insertion hole 67 (see FIG. 6A) is made in a ceiling surface of the storage part 61, through which the armature 71 is inserted the storage part 61 between the guide plates 62. A pair of linear protrusions 68 extending vertically from the upper side, a plate-like protrusion 69 extending horizontally in the center, and a curved protrusion 70 including a curved surface protruding inward on the lower side are formed on an inward surface on deep side of the storage part 61. The socket 63 detachably retains a reset signal input plug (not illustrated) connected to the reset signal input terminal 55.

As illustrated in FIG. 5, the armature 71 is formed into a gate-type plate shape, and includes step parts 72 that are formed at an upper edge of the armature 71 to protrude toward both the sides and a pair of downwardly extending leg parts 73. With the drive mechanism 40 being assembled, the return spring 75 is retained in a compressed state between the step part 72 of the armature 71 and the upper surface of the storage part 61. Therefore, the return spring 75 pushes up the armature 71 to maintain the operation piece 13 at an off state in which the operation piece 13 is turned in an off direction.

The cover 77 has a lateral shape that can laterally be fitted in the case 60, and includes a pair of upper-side elastic arm parts 78 extending in parallel from both side edge portions on the upper side and a pair of lower-side elastic arm parts 79 extending in parallel from both side edge portions on the lower side. A horizontally extending upper-side latching hole 81 is made in the upper-side elastic arm part 78. A horizontally extending lower-side latching hole 82 is made in the lower-side elastic arm part 79.

A method for assembling the drive mechanism 40 will be described as a preceding process of assembling the switch 1. The lead of the coil 48 wound around the outer peripheral surface of the coil winding part 44 of the bobbin 43 is bound and soldered to the reset signal input terminal 55 fixed to the lower end edge part 46. The permanent magnet 56 is fitted in the attaching hole 53 of the yoke 50, and the arm part 51 is inserted through the through-hole 42 of the bobbin 43 from below, thereby forming the electric magnet device 41 except the armature 71. Because the notch 52 is provided in the yoke 50, the yoke 50 can easily be gripped with a tool through the notch, thereby improving workability.

Then the electric magnet device 41 is stored in the storage part 61 of the case 60. At this point, the upper end edge part 45 of the bobbin 43 abuts on the linear protrusion 68, and abuts on the ceiling surface of the storage part 61. Additionally, the lower end edge part 46 abuts on the upper side surface of the plate-like protrusion 69, whereby the electric magnet device 41 is positioned in the storage part 61 (case 60). At this point, the yoke 50 is retained and fitted in the storage part 61 with a play, so that the yoke 50 can oscillate with the arm part 51 being inserted through the through-hole 42. Accordingly, surface contact between the arm part 51 and the leg part 73 of the armature 71 is facilitated. As illustrated in FIG. 6A, because the yoke 50 is sucked to the reset signal input terminal 55 by a magnetic force of the permanent magnet 56, the yoke 50 floats from a bottom portion of the case 60 with a predetermined gap.

Then the cover 77 is mounted to the case 60 so as to cover the opening lower side of the case 60 and the socket 63. At this point, the upper-side latching hole 81 of the cover 77 is latched in the upper-side latching protrusion 65 of the case 60, and the lower-side latching hole 82 is latched in the lower-side latching protrusion 66, thereby retaining the electric magnet device 41. Finally the armature 71 is inserted through the through-hole 42 of the bobbin 43 through the insertion hole 67 of the case 60 while the return spring 75 disposed above the storage part 61 is interposed between the armature 71 and the through-hole 42, thereby completing the drive mechanism 40.

Then, as illustrated in FIG. 3, the first fixed contact pieces 31 and the second fixed contact pieces 34 are inserted in and attached to terminal holes (not illustrated) made in the bottom surface of the housing 10. The bottom surface of the support part 24 of the movable contact piece 23 is turnably placed on the first fixed contact 32 of the first fixed contact piece 31. The lower end of the coupling body 21 is inserted in the protrusion 25 of the movable contact piece 23, and the retention part 16 of the operation piece 13 is fitted in the upper end of the coupling body 21. The support shaft 15 of the operation piece 13 is fitted in the circular hole 11 of the housing 10, and the support shaft 15 of the operation piece 13 is turnably attached to the housing 10. Therefore, the power switch mechanism 20 is completed. Finally, as illustrated in FIGS. 6, the drive mechanism 40 is incorporated from below on the other side of the housing 10 in which the power switch mechanism 20 is incorporated, and the switch 1 is completed.

An operation of the switch 1 will be described below.

As illustrated in FIGS. 6A and 6B, when the power switch mechanism 20 is in the off state, the return spring 75 extends to bias the armature 71 upward. Therefore, the upper end surface of the armature 71 pushes up the abutment plate 17, and the operation piece 13 is in the off state. In the off state, the coupling body 21 of the power switch mechanism 20 is bent into the chevron shape toward the side of the drive mechanism 40. The movable contact 28 of the movable contact piece 23, which turns with the upper end of the first fixed contact 32 as a support point, separates from the second fixed contact 35, and is in the off state.

Figure 7B:
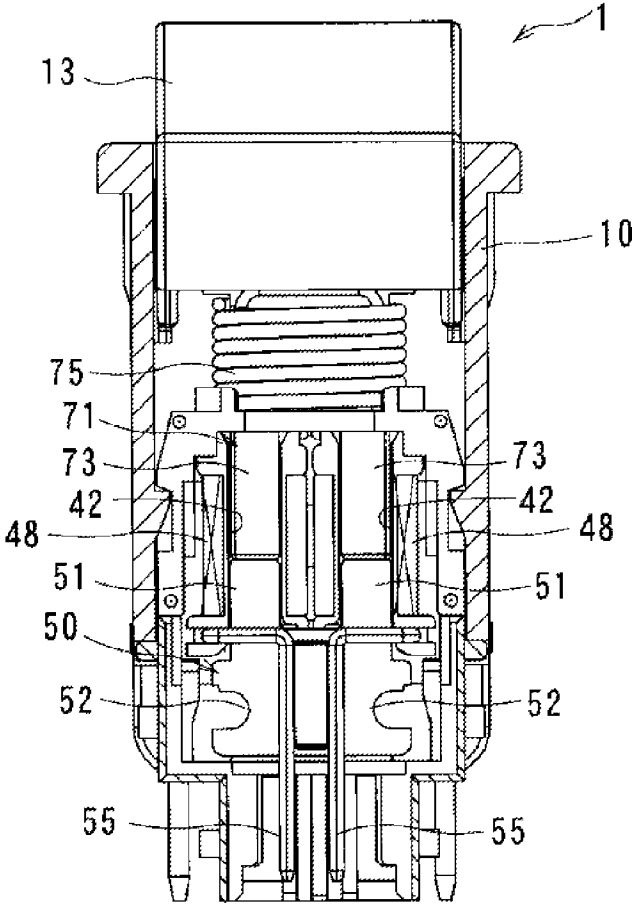
FIG. 7B is a side sectional view illustrating the switch in FIG. 7A.
Figure 7A:
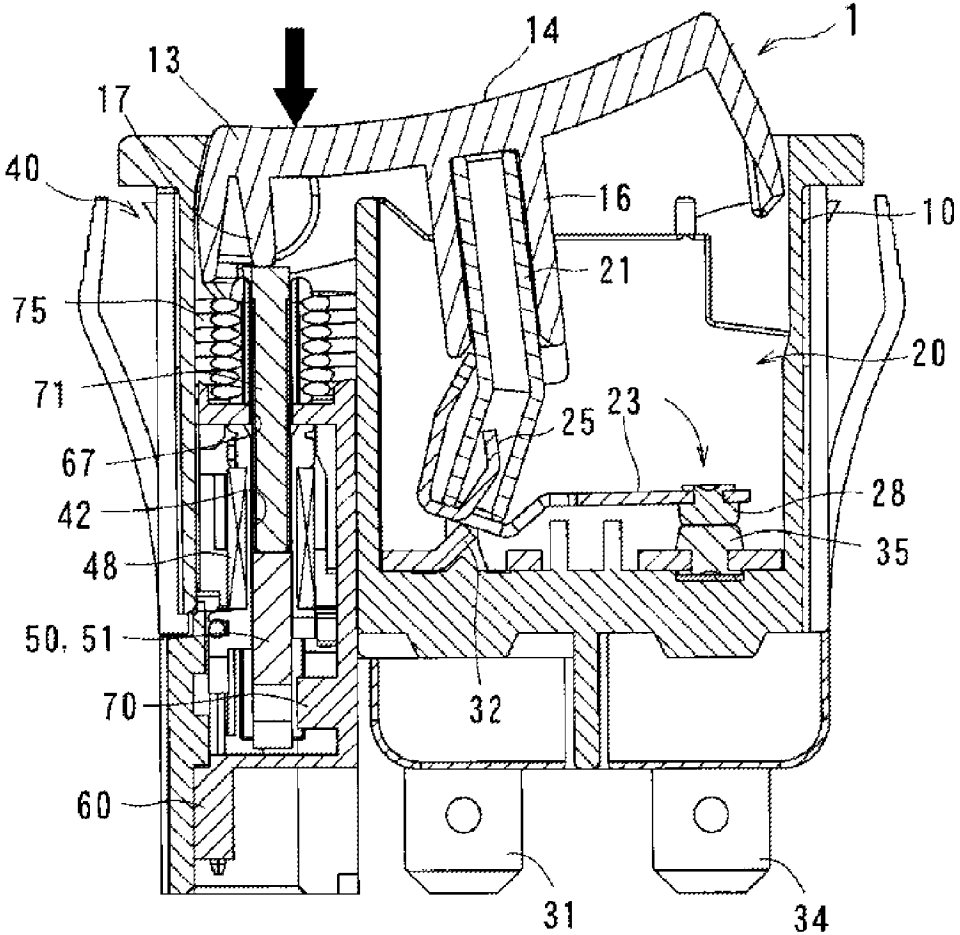
FIG. 7A is a front sectional view illustrating the switch after the operation.

As illustrated in FIGS. 7A and 7B, when the side of the abutment plate 17 of the operation surface 14 is pressed downward to turn on the switch 1, the abutment plate 17 pushes down the armature 71 against a biasing force of the return spring 75. Therefore, the armature 71 moves downward, the leg part 73 is attracted to the arm part 51 of the yoke 50 due to the magnetic force of the permanent magnet 56 interposed between opposite surfaces of the arm part 51, and the switch 1 becomes the on state.

When the switch 1 is turned on, the coupling body 21 of the power switch mechanism 20 is bent into the chevron shape toward the opposite side to the drive mechanism 40. Therefore, the protrusion 25 is pressed onto the right side in FIG. 7, and the movable contact piece 23 turns clockwise in FIG. 7 about the upper end of the first fixed contact 32. The movable contact 28 abuts on the second fixed contact 35 to turn on the power.

Figure 8:
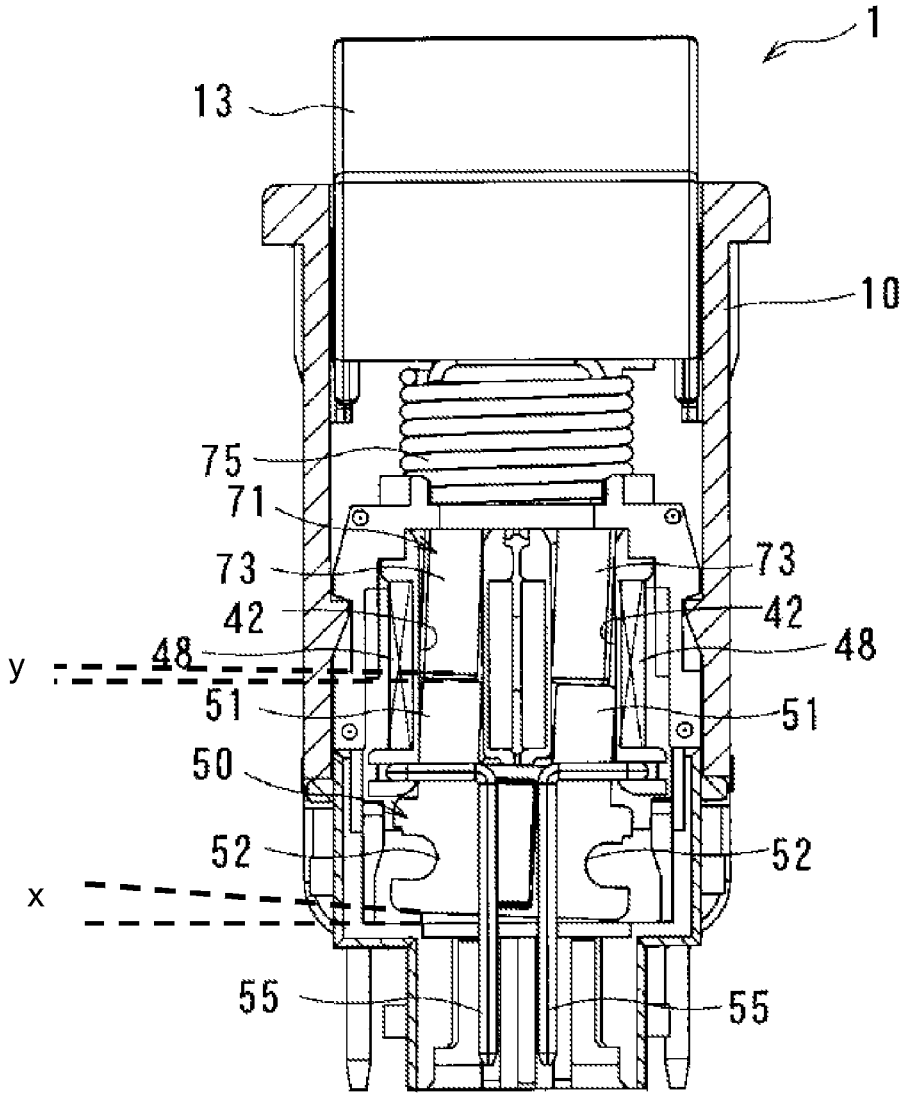
FIG. 8 is a side sectional view illustrating the switch in a state in which an armature is inclined during the operation.

As illustrated in FIG. 8, in the present invention, the yoke 50 is attached to and fitted in the bobbin 43 with the play, so that the yoke 50 can be inclined according to an inclination of the armature 71. Accordingly, the leg part 73 and the arm part 51 come into surface contact with each other to decrease a magnetic resistance, and the leg part 73 and the arm part 51 can be attracted to each other with the large attractive force. Therefore, even if a vibration or an impact is applied, the attraction state between the leg part 73 and the arm part 51 can be maintained to prevent the malfunction.

In the embodiment of the present invention, a ratio of an oscillation angle 'x' of the yoke 50 to an oscillation angle 'y' of the armature 71 is preferably greater than 1:1 and less than or equal to 3:1. See, FIG. 8. When the ratio of the oscillation angles x, y of the yoke 50 to the armature 71 is less than or equal to 1:1, that is for example, 1:0.5, the leg part 73 and the arm part 51 can-not come into surface contact with each other, and the desired effect cannot be obtained. When the ratio of the oscillation angles x, y of the yoke 50 to the armature 71 is greater than 3:1, that is for example, 4:1, in attracting the armature 71 and the yoke 50 to each other, the lower end portion of the leg part 73 comes into contact with an upper-end corner portion of the arm part 51, and an attraction surface on the side of the armature 71 is abraded to degrade the attractive force. Accordingly, when the ratio of the oscillation angle x of the yoke 50 to the oscillation angle y of the armature 71 is greater than 1:1 and less than or equal to 3:1, the leg part 73 and the arm part 51 come surely into surface contact with each other, and the abrasions of the attraction surfaces of the leg part 73 and the arm part 51 can be controlled to prevent the degradation of the attractive force. In the present embodiment, the attraction surfaces of the leg part 73 and the arm part 51 are formed into the square shape, but are not limited thereto. The same effect is obtained even if the attraction surfaces of the leg part 73 and the arm part 51 are formed into a circular shape. The square shape or the circular shape of the attraction surfaces enhances a degree of design freedom.

When a voltage that generates the reverse magnetic force is applied to the coil 48 through the reset signal input terminal 55 in order to turn off the switch 1 in the on state, a magnetic flux of the permanent magnet 56 is canceled to relatively lower the magnetic force between the armature 71 and the yoke 50. Therefore, the armature 71 is pushed upward by the elastic force of the return spring 75, and the upper end surface of the armature 71 pushes up the abutment plate 17. As a result, the operation piece 13 turns about the support shaft 15, and the power switch mechanism 20 returns to the off state illustrated in FIG. 6A.

Figure 9:
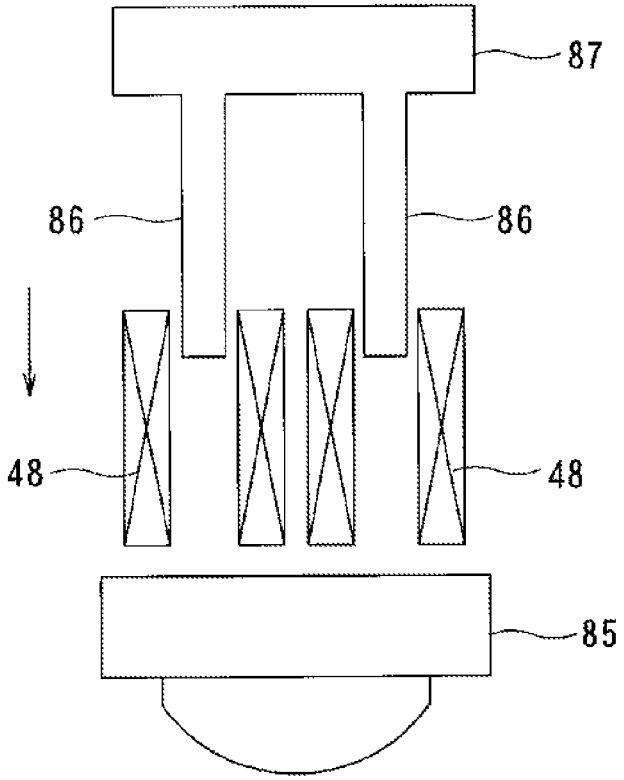
FIG. 9 is a schematic diagram illustrating an electric magnet device according to a second embodiment of the present invention.

The present invention is not limited to the above embodiment, but various modifications can be made. In the above embodiment, as to the yoke 50 and the armature 71, the arm part 51 and the leg part 73 are inserted through the through-hole 42 of the bobbin 43, but not limited thereto. Alternatively, for example, in an electric magnet device according to a second embodiment illustrated in FIG. 9, a plate-like yoke 85 is disposed on the lower end part of the coil 48, an armature 87 including a pair of downwardly extending leg parts 86 is disposed on the upper end part of the coil 48. For the sake of convenience, the bobbin 43 is omitted in this electric magnet device. The armature 87 is moved downward so that the lower end surfaces of the leg parts 86 are inserted through inside the coil 48 to be attracted to the upper surface of the yoke 85. At this point, because the yoke 85 is attached to and fitted in the case 60 with the play, the yoke 85 can be inclined according to the inclination of the armature 87, and the leg part 86 can come into surface contact with the yoke 85.

Figure 10:
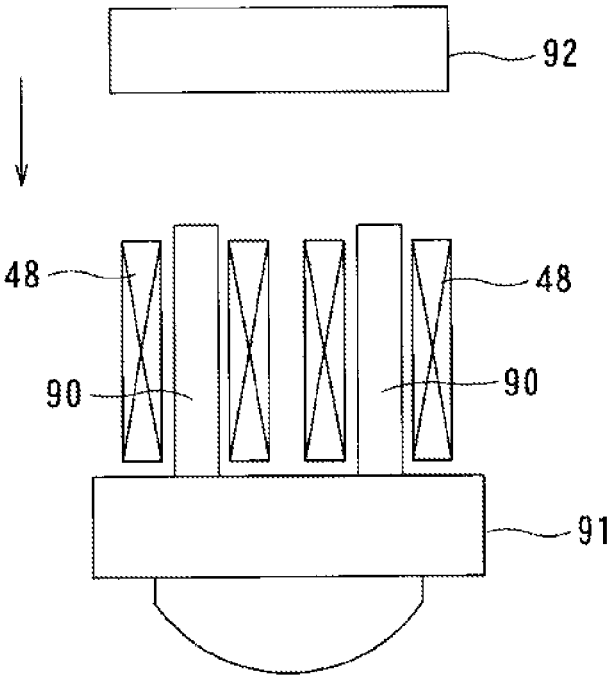
FIG. 10 is a schematic diagram illustrating an electric magnet device according to a third embodiment of the present invention.

As another example, in an electric magnet device according to a third embodiment illustrated in FIG. 10, a yoke 91 including a pair of upwardly extending arm parts 90 inserted through inside the coil 48 is disposed on the lower end part of the coil 48, and a plate-like armature 92 is disposed on the upper end part of the coil 48. For the sake of convenience, the bobbin 43 is omitted in this electric magnet device. The lower surface of the armature 92 is attracted to the upper end surface of the arm part 90 by moving the armature 92 downward. At this point, because the yoke 91 is attached to and fitted in the case 60 with the play, the yoke 91 can be inclined according to the inclination of the armature 92, and the armature 92 can come into surface contact with the arm part 90.

The electric magnet device 41 of the first embodiment includes the pair of coils 48, the yoke 50 including the pair of arm parts 51, and the armature 71 including the pair of leg parts 73, but not limited thereto. Alternatively, for example, a configuration in which the electric magnet device includes the one coil, the yoke includes the one arm part, and the armature includes the one leg part may be employed. The electric magnet device of the present invention can of course be applied not only to the switch but also to other electric instruments.

There has thus been shown and described an electromagnetic device and switch using the same which fulfills all the advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electric magnet device comprising:

a coil adapted to insert through at least one of an armature and a yoke so as to attract surfaces of the yoke and the armature, which are opposed to each other, to receive a voltage, to excite for separating the surfaces of the yoke and the armature;

the armature disposed on one end side of the coil and the yoke disposed on the other end side of the coil and adapted to oscillate, wherein an oscillation angle of the yoke is greater than an oscillation angle of the armature.

2. The electric magnet device according to claim 1, wherein a ratio of the oscillation angle of the yoke to the oscillation angle of the armature is greater than 1:1 and less than or equal to 3:1.

3. The electric magnet device according to claim 2, wherein attraction surfaces of the armature and the yoke have a square shape.

4. A switch comprising the electric magnet device according to claim 3.

5. The electric magnet device according to claim 2, wherein attraction surfaces of the armature and the yoke have a circular shape.

6. A switch comprising the electric magnet device according to claim 5.

7. A switch comprising the electric magnet device according to claim 2.

8. The electric magnet device according to claim 1, wherein attraction surfaces of the armature and the yoke have a square shape.

9. A switch comprising the electric magnet device according to claim 8.

10. The electric magnet device according to claim 1, wherein attraction surfaces of the armature and the yoke have a circular shape.

11. A switch comprising the electric magnet device according to claim 10.

12. The electric magnet device according to the claim 1, wherein the yoke comprises an assembly notch in each of both lateral edge portions of the yoke.

13. A switch comprising the electric magnet device according to claim 12.

14. A switch comprising the electric magnet device according to claim 1.

* * * * *